United States Patent [19]

Lyons et al.

[11] Patent Number: 4,480,024

[45] Date of Patent: Oct. 30, 1984

[54] INDUSTRIAL X-RAY PHOTOTHERMOGRAPHIC SYSTEM

[75] Inventors: Thomas D. Lyons, St. Paul, Minn.; Gregory J. McCarney, Hudson, Wis.

[73] Assignee: Minnesota Mining and Manufacturing Company, St. Paul, Minn.

[21] Appl. No.: 544,388

[22] Filed: Oct. 21, 1983

[51] Int. Cl.[3] ..... G03C 5/16

[52] U.S. Cl. ..... 430/139; 430/496; 430/523; 430/619; 430/620; 430/966; 378/182

[58] Field of Search ..... 430/139, 496, 619, 966, 430/523, 620; 378/169, 182, 185

[56] References Cited

U.S. PATENT DOCUMENTS

| | | | |
|---|---|---|---|
| 3,457,075 | 7/1969 | Morgan et al. | 96/67 |
| 3,462,599 | 8/1969 | Erikson et al. | 378/185 |
| 3,725,704 | 4/1973 | Buchanan et al. | 250/71 R |
| 4,081,278 | 3/1978 | Dedinas et al. | 430/967 |
| 4,130,428 | 12/1978 | Van Doorselaer | 430/966 |
| 4,234,670 | 11/1980 | Kaukeinen et al. | 430/618 |
| 4,336,323 | 6/1982 | Winslow | 430/339 |
| 4,394,439 | 7/1983 | Robillard | 430/967 |

FOREIGN PATENT DOCUMENTS 1110046 4/1968 United Kingdom .

OTHER PUBLICATIONS

U.S. Ser. No. 510,068 Filed Jul. 1, 1983, entitled: Spectrally Sensitized Photothermographic Materials" Inventor: K. A. Penfound.

*Primary Examiner*—J. Travis Brown

*Attorney, Agent, or Firm*—Donald M. Sell; James A. Smith; Mark A. Litman

[57] ABSTRACT

Photothermographic systems have not been useful in combination with X-ray purposes because of low speed, poor resolution and poor contrast. A particularly designed photothermographic element in combination with a rare-earth intensifying screen provides a high quality, fast, high resolution photothermographic radiographic system.

7 Claims, No Drawings

INDUSTRIAL X-RAY PHOTOTHERMOGRAPHIC SYSTEM

FIELD OF THE INVENTION

This invention relates to a novel industrial photothermographic radiographic system. The system combines a structurally unique silver halide photothermographic emulsion and a high efficiency rare earth phosphor screen.

BACKGROUND OF THE ART

Nondestructive testing of articles and materials has become an integral part of quality control in modern manufacturing industries. This type of testing enables on-line and intensive evaluation of the structural soundness of products. One of the most commonly used forms of nondestructive testing is radiographic images taken on industrial materials. Industrial X-rays have been used for many years in the testing of support beams used in the construction of buildings, bridges and the like. They are particularly useful in the evaluation of welds and in testing metal plates for minute flaws which could affect performance.

As industrial demands on materials become more stringent and the tolerance for flaws becomes reduced, more precise testing methods are required. In all imaging processes, including photography and radiography, there is an inherent limit in the resolution available through the process because of the physical elements used. In the practice of modern industrial X-ray procedures, the use of intensifying screens adds a further limit on the resolution available in radiographs. It has heretofore been generally accepted that the phosphor grains in intensifying screens and the screens themselves were the limiting factor in the graininess or resolution available in radiographs used in nondestructive testing (cf. *Nondestructive Testing,* 2d Ed. Warren J. McGonnagle, Science Publishers, 1971, pages 119–123, *Radiography in Modern Industry,* 3d Ed., Eastman Kodak, 1969, pages 34–38, and *Physics of Industrial Radiology,* R. Halmshaw, London, Heywood Books, 1966, pages 110 and 176). This limitation was believed to be a result of the fact that visible radiation emitted from the phosphor grain is spread out rather than projected in a linear path like the incident X-rays.

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and British Pat. No. 1,110,046 discloses the use of complexes of inorganic or organic silver salts as image source materials.

In both photographic and photothermographic emulsions, exposure of the silver halide to light produces small clusters of silver atoms. The imagewise distribution of these clusters is known in the art as the latent image. This latent image generally is not visible by ordinary means and the light sensitive article must be further processed in order to produce a visual image. The visual image is produced by the catalytic reduction of silver which is in catalytic proximity to the specks of the latent image.

Photothermographic emulsions, because of their relatively slow speed and coarse images, have generally been limited to high intensity machine exposures and have not been used with low intensity light exposure.

SUMMARY OF THE INVENTION

The present invention relates to the combination of a specialized photothermographic coating and a rare-earth intensifying screen which are uniquely adapted to one another for the purpose of radiographic imaging. The photothermographic layer is dye-sensitized to the spectral emissions of the intensifying screen and the combination of screen and film has an amplification factor greater or equal to at least 50. The emulsion also has a range of the molar ratio of silver salt to organic acid of 1.5/1 to 6.2/1.

DETAILED DESCRIPTION OF THE INVENTION

Photothermographic emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, ordinarily may be any material which contains a reducible source of silver ions. Silver salts of organic acids, particularly long chain (10 to 30, preferably 15 to 28 carbon atoms) fatty carboxylic acids are required in the practice of the present invention. Complexes of organic or inorganic silver salts wherein the ligand has a gross stability constant between 4.0 and 10.0 are not practical in the present invention. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 20 percent by weight of the imaging layer. In a two-layer construction, if the reducing agent is in the second layer, slightly higher proportions, of from about 2 to 20 percent tend to be more desirable.

Toners such as phthalazinone, phthalazine and phthalic acid are not essential to the construction, but are highly desirable. These materials may be present, for example, in amounts of from 0.2 to 5 percent by weight.

The binder may be selected from any of the well-known natural and synthetic resins such as gelatin, polyvinyl acetals, polyvinyl chloride, polyvinyl acetate, cellulose acetate, polyolefins, polyesters, polystyrene, polyacrylonitrile, polycarbonates, and the like. Copolymers and terpolymers are, of course, included in these definitions. The polyvinyl acetals, such as polyvinyl butyral and polyvinyl formal, and vinyl copolymers, such as polyvinyl acetate/chloride are particularly desirable. The binders are generally used in a range of from 20 to 75 percent by weight of each layer, and preferably about 30 to 55 percent by weight.

In describing materials useful according to the present invention, the use of the term 'group' to characterize a class, such as alkyl group, indicates that substitution of the species of that class is anticipated and included within that description. For example, alkyl group includes hydroxy, halogen, ether, nitro, aryl and carboxy substitution while alkyl or alkyl radical includes only unsubstituted alkyl.

As previously noted, various other adjuvants may be added to the photothermographic emulsions of the present invention. For example, toners, accelerators, acutance dyes, sensitizers, stabilizers, surfactants, lubricants, coating aids, antifoggants, leuco dyes, chelating agents, and various other well known additives may be usefully incorporated. The use of acutance dyes matched to the spectral emission of the intensifying screen is particularly desirable.

The substrate of the present invention may comprise paper, coated paper (e..g, titanium dioxide in a binder), polymeric film, dye-containing polymeric film or coated polymeric film. The substrate must be visually homogeneous, white and translucent. This enables the radiograph to be interpreted both by transmitted and reflected light. It may be as thin as two mils ($5\times10^{-5}$ m) or as thick as desired for structural integrity. Supports as thick as 1 mm or more would even be desirable in some circumstances. The substrate is a white, visually homogeneous, translucent plastic film. As an indicator of the 'translucent' property of the substrate, optical opacity measurements can be made to further define the level of light scattering and reflection from the substrate. The range of preferred opacity values (translucency), as expressed by the contrast ratio of the substrate, is 80 to 99%, with a most preferred range of 90 to 99%. These opacity values may be measured with a Hunterlab 'Labscan' spectrocolorimeter comparing substrate reflectivity backed by a white standard plaque versus a black standard plaque. Preferred translucent films may be made by pigment loading of the film, pigmented surface coatings and/or microbubbles (vesicles) within the film. The polymeric material may be any of the well known polymer film-forming materials such as polyesters (e.g., polyethyleneterephthalate), cellulose acetate (or triacetate), polyvinyl acetals (e.g., polyvinyl butyral), polyolefins, polyamides, polycarbonates, polyacrylic resins and the like.

The balance in properties of the photothermographic emulsion must be precisely restricted by the proportions of materials in the emulsion. The proportions of the silver salt and organic acid are particularly critical in obtaining necessary sensitometric properties in the photothermographic element. Commercially available photothermographic materials including dry silver papers of various manufacturers, thermal diazo films and vesicular films, even when appropriately spectrally sensitized do not perform sufficiently well to pass any of the industrial X-ray standards.

In conventional photothermographic emulsions, it is common to use approximately pure silver salts of organic acids (e.g., behenic acid, stearic acid and mixtures of long chain acids) as the substantive component of the emulsion. Sometimes minor amounts or larger amounts of the acid component is included in the emulsion. In the practice of the present invention the molar ratio of organic silver salts to organic acid must be in the range of 1.5/1 to 6.2/1 (salt/acid). Below that range, the contrast has been found to be too low, and above that range the speed and background stability of the emulsions drop off unacceptably. It is preferred that the ratio be in the range of 2.0/1 to 4.0/1 and more preferred that the ratio is in the range of 2.0/1 to 3.50/1.

The silver halide may be provided by in situ halidization or by the use of pre-formed silver halide. The use of sensitizing dyes is particularly desirable. These dyes can be used to match the spectral response of the emulsions to the spectral emissions of the intensifier screens. It is particularly useful to use J-banding dyes to sensitize the emulsion as disclosed in copending U.S. patent application Ser. No. 510,068, filed July 1, 1983.

By using the critical range of proportions in the emulsion and the appropriate sensitizing dye to match response and screen emissions, films with the minimum necessary performance characteristics can be prepared according to the teachings of this invention. These minimum performance characteristics are defined as a contrast of 2.0 or greater and a diffuse reflection optical density of 1.0 when exposed to 6 ergs/cm$^2$ (at the maximum wavelength sensitivity of the film) and developed at 131° C. for 5 seconds. For example, in certain embodiments of the present invention a green-sensitized emulsion was imaged through a P-22 green filter (simulating P-22 green phosphor) with a millisecond flash for a $10^{2.78}$ meter-candle-seconds exposure and development at 131° C. for 4 seconds. The emulsion had a contrast of approximately 3 and a reflection optical density of 1.0 with an exposure of about 5 ergs/cm$^2$.

The process would be performed by using a conventional X-ray projection source or other high energy particle radiation sources including gamma and neutron sources. As well known in the art, the particular phosphor used should have a high absorption coefficient for the radiation emitted from the source. Usually this radiation is high energy particle radiation which is defined as any of X-rays, neutrons and gamma radiation. The industrial material would be placed between the controllable source of X-rays and the industrial radiographic system of the present invention. A controlled exposure of X-rays would be directed from the source and through the industrial material so as to enter and impact the radiographic system at an angle approximately perpendicular to the plane or surface of the intensifying screen and the photographic film contiguous to the inside surface of the screen. The radiation absorbed by the phosphors of the screen would cause light to be emitted by the screen which in turn would generate a latent image in the silver halide centers in the emulsion. Conventional thermal development would then be used on the exposed film.

The silver halide grains may be selected from amongst any of the known photographic silver halide materials such as silver chloride, silver bromide, silver iodide, silver bromoiodide, silver chlorobromoiodide, silver chlorobromide, and the like and mixtures thereof.

The vast list of known photographic adjuvants and processing aids may be used in the practice of the present invention. These materials include chemical sensitizers (including sulfur and gold compounds), development accelerators (e.g., onium and polyonium compounds), alkylene oxide polymer accelerators, antifoggant compounds, stabilizers (e.g., azaindenes especially the tetra- and pentaazaindenes), surface active agents (particularly fluorinated surfactants), antistatic agents (particularly fluorinated compounds), plasticizers, matting agents and the like.

A dye underlayer may be used which contains a decolorizable dye. By the term 'decolorizable', it is meant that the light absorbing ability of the dye must be substantially diminishable or capable of being completely removed. For example, the dye in the binder which forms an underlayer between the substrate and the photothermographic may be readily thermally bleachable in the processing (developing) of the film element so that the dye would be bleached out of the element. The dye could also be alkaline solution bleachable, heat bleachable, sulfite bleachable, or removable in any other manner which would not require destruction of the image in the film. There are many ways of accomplishing removability known in the art, but the preferred means is using dyes which are bleachable at conventional developing temperatures. Heat bleaching of the dyes may be accomplished by selecting dyes which are themselves thermolabile or by combining them with materials which can bleach the dyes when heated. The combination of bleachable dyes with nitrate salts capable of liberating $HNO_3$ or nitrogen oxides when heated to 160°–200° C. (as taught in U.S. Pat. No. 4,336,323) are particularly desirable.

The dye underlayer is particularly important because it prevents cross-talk within the radiographic element. Cross-talk occurs when light emitted from one screen (in a two-screen cassette system) passes through the emulsion and forms a latent image in a second emulsion. The dye layer can also act to prevent halation in a single side coated film where the light might be reflected off the base after passing through the emulsion.

The industrial X-ray system of the present invention combines the defined photothermographic film with a cassette having at least one intensifying screen therein. The screen is coated with a phosphor which absorbs the incident X-rays and converts the absorbed energy to visible light which then images the photothermographic film. The particular wavelength of like emitted by the phosphors is characteristic of the phosphor and independent of the energy or wavelength of the incident X-rays.

The X-ray intensifying screens used in the practice of the present invention are rare earth phosphor screens well known in the art. These phosphors are materials which absorb incident X-rays and emit radiation in a different portion of the electromagnetic spectrum, particularly visible and ultraviolet radiation. Rare earth (gadolinium and lanthanum) oxysulfides and gadolinium or lanthanum oxybromides are particularly useful phosphors. The gadolinium oxysulfides and the lanthanum oxysulfides and the phosphates and arsenates can be doped to control the emission wavelengths and improve their efficiency. Many of these phosphors are shown in U.S. Pat. No. 3,725,704 and U.K. Pat. No. 1,565,811. The phosphate and arsenate phosphors may be generally represented by the formula $$La_{(1-a-b-c-d-e)}Gd_aCe_bEu_cTb_dTh_eXO_4$$

wherein a is 0.01 to 0.50, b is 0 to 0.50, c is 0 to 0.02, d is 0 to 0.10, e is 0 to 0.02 and X represents phosphorous or arsenic atoms or mixtures thereof. Preferable, c is 0, a is 0.05 to 0.30 and d is 0 to 0.02. The sum of b, c, d and e should be greater than zero and should most preferably be at least 0.005.

The oxysulfide rare earth phosphors may be represented by the formula $$La_{(2-g-f)}Gd_aLu_hZ_fO_2S$$

wherein Z is the dopant element or elements, g is 0 to 1.99, h is 0 to 1.99 and f is 0.0005 to 0.16. Preferably b is 0, a is 0.15 to 1.00, f is 0.0010 to 0.05 and Z is terbium. It is essential that the particle size of the phosphors be less than 6 microns and preferably less than 5 microns. There must be at least 250 g/m$^2$ of phosphor, and preferably 300–700 g/m$^2$.

Single screen cassettes may be used with single-side coated photothermographic elements in the practice of the present invention. Double screen cassettes may be used with either single-side or double-side coated elements, but without any significant benefit and at increased cost for the film.

These and other aspects of the invention are shown in the following non-limiting Examples.

EXAMPLE 1

A silver dispersion was prepared by blending the following ingredients:

| Component | Parts by Weight |
|---|---|
| Silver behenate full soap 12.5% solids in methylethyl ketone | 35.2 |
| Silver behenate half soap (50/50 acid/salt) 15.5% solids in acetone | 21.12 |
| Toluene | 20.18 |
| $HgBr_2$ 5% in methanol | 2.59 |
| Polyvinylbutyral (B-76) | 9.02 |
| Mercuric Acetate 2.1% solids in methanol | 0.76 |

-continued

| Component | Parts by Weight |
|---|---|
| 2,2'-methylenebis-(4-methyl-6-tert-butylphenol) | 2.35 |
| Methyl methacrylate resin 30% solids in toluene/butenol 9.1 | 6.57 |
| Imidazolidine spectral sensitizing dye matched to emission output of screen .1166% solids in methanol | 3.77 |
| Acetone | 4.26 |
| Antihalation dye .319 solids in methylethyl ketone | 3.67 |

The dispersion was coated onto a titanium dioxide loaded 2-mil ($1\times10^{-4}$ m) polyethyleneterephthalate substrate. Substrate opacity measured 91.5% on a spectrocolorimeter. The coating weight of the dispersion was 12.9 grams/m$^2$ which represents a silver coating weight of about 0.93 g/m$^2$.

A protective topcoat formulation was prepared with the following components:

| Component | Parts by Weight |
|---|---|
| Acetone | 67.65 |
| Methylethyl ketone | 15.0 |
| Cellulose acetate ester | 4.6 |
| Silica | 0.28 |
| Methanol | 11.22 |
| Phthalazine | 0.51 |
| 4-Methyl-phthalic acid | 0.36 |
| Tetrachlorophthalic acid | 0.11 |
| Tetrachlorophthalic anhydride | 0.085 |

This solution was applied at a dry weight of 3 g/m$^2$ over the dried silver dispersion.

The finished photothermographic film was exposed with a xenon flash sensitometer through a P-22 green phosphor simulation filter at a setting of $10^{-3}$ seconds through a 0–4 continuous density wedge. The exposed sample was processed for four seconds at 131° C. in a roller driven thermal processor. The sensitometry was recorded as $D_{min}=0.16$, $D_{max}=1.68$, Contrast 3.00, Sensitivity 6 ergs/cm$^2$ measured at a gross density of 1.0.

EXAMPLE 2

The film of Example 1 was placed in a cassette with a 3M Trimax® phosphor screen adjacent the protective topcoat. The cassette was exposed for 300 milliamp-seconds at 36 inches film focal distance to a 125 KV source through an aluminum test bar. After development, the sensitometric results were found to be substantially the same as in Example 1.

The resulting radiograph from the present invention has unusual optical properties:

(a) the test radiograph may be interpreted by reflected light, with or without magnification. The system is especially useful in field radiography such as pipeline weldment inspection.

(b) the test radiograph may be interpreted by transmitted light with the aid of a high intensity industrial X-ray viewer. This is the normal method of X-ray inspection in foundry practice.

The system provides surprisingly high resolution of detail in the radiograph. Test target resolution in excess of 200 lines per inch has been achieved in the radiograph. This feature of high resolution combined with the photographic contrast achieved in the photothermographic translucent film provides 2% radiographic sensitivity in the processed radiograph as defined by ASTM E94 standard. This radiographic sensitivity meets the standard quality level specified in MIL-STD-271E, AWS Structural Welding Code (1982), and other industrial standards for radiography.

The amplification factor of 50 or greater from the rare earth intensifying screen provides practical exposure times with conventional X-ray sources used in nondestructive testing. The surprisingly high resolution achieved in the system with this amplification factor is partially due to the efficiency of the rare earth phosphor. Using terbium doped gadolinium oxysulfide with an average grain size of 5 μm and a screen coating weight of 300 gms/m$^2$, those features of resolution and amplification which meet requirements of nondestructive testing have been produced.

Current industrial X-ray practice requires wet processing of the exposed radiograph. The chemicals used in the aqueous baths are toxic to the environment and thus require special means for disposal. In addition the wet chemistry is corrosive and expensive. The wet processing of industrial X-ray films is especially troublesome in field inspections such as pipeline weld inspection. Here portable laboratories including trailers and other large vehicles equiped with wet chemical development means are an expensive requirement. These conditions are eliminated or vastly improved by the system of this invention. The heat processing of the photothermographic film is accomplished with a simple electrical hot roll processor. The electricity required may be obtained from batteries, generators or the like. This allows on site development of the radiographs with considerable savings in time and expense.

EXAMPLE 3

A vacuum cassette, E-Z-EM's VAC-U PAC™ was loaded with an 8×10 inch Trimax-6, 3M Co. rare earth gadolinium oxysulfide phosphor screen together with an 8×10 inch sheet of the photothermographic film of Example 1. The cassette was evacuated by means of a water aspirator and 100 gms of wheat grain was uniformly distributed on the surface. This system was exposed to X-ray under the following conditions:

kilovoltage=17 KVp
milliamp=3 ma
film-focal-distance=24 inch
Exposure time=2 minutes The photothermographic film was removed from the cassette and developed by contact with a moving roller heated to 270° F. The total development time was 10 seconds. The radiograph was viewed by reflected light through a LUXO Magnifier which enlarged the image three times.

The insect damaged kernels within the sample were easily counted and the percent of infestation recorded.

EXAMPLE 4

A printed circuit board containing active and passive components was placed on a vacuum cassette containing a rare earth phosphor screen and photothermographic film as in Example 3. In addition, an image quality indicator, ASTM Type B, No. 1, was placed on top of the board. After evacuation of the cassette the system was exposed to an X-ray source:

70 KVp
60 milliamp seconds
36 inch ffd

The photothermographic film was developed as in Example 3. The radiograph was examined by transmitted light with the aid of a PENETREX® high intensity industrial X-ray viewer.

The complete set of six tungsten wires in the Type B image quality indicator were visible in the radiograph. This assures detection of defects as small as 0.0005 inches in the inspection of the printed circuit board.

EXAMPLE 5

A radiograph of the printed circuit board of Example 4 was prepared using the photothermogrpahic film of Example 1 without the use of a phosphor amplifying screen. The following exposure technique was applied to the cassette containing the photothermographic film with the circuit board interposed toward the beam:

70 KVp
3000 milliamp seconds
36 inch ffd

After thermal development as in Example 2 only a weak image of the circuit board was produced. A reflection density of 0.5 was measured on the portion of the radiograph corresponding to the thin portion of the circuit board. This density was insufficient for adequate inspection of the circuit board. The necessity of the intensifying screen is shown by this Example.

EXAMPLE 6

An 8×10 inch flexible vinyl cassette, Roentgen Industrial Corp., was loaded with a Trimax-6 rare earth phosphor screen (3M Co.) together with the photothermographic film of Example 1. An aluminum casting varying in thickness between 0.75 and 1.0 inches was placed in contact with the cassette. Appropriate aluminum penetrameters, MIL-STD-271, were placed on the surface of the casting towards the X-ray source. The X-ray exposure was:

90 KVp
300 milliamp seconds
36 inch ffd

The photothermographic film was developed as in Example 3.

The radiograph was viewed by transmitted light as in Example 4. The 2-2T holes in both 0.75 and 1.0 inch penetrameters were clearly visible as was the outline of the penetrameter. The radiograph thus provides 2% radiographic sensitivity as defined in ASTM-E94.

We claim:

1. An industrial X-ray imaging system comprising (a) a cassette (b) at least one X-ray intensifying screen with rare-earth phosphor particles having an average diameter of less than 6 microns on an interior surface of said cassette (c) a light sensitive material adjacent said intensifying screen, wherein said light-sensitive material is characterized by being a photothermographic emulsion comprising a long-chain fatty carboxylic acid, a layer of silver salt of a long-chain fatty carboxylic acid, silver halide, an organic reducing agent for silver, and a binder on a visually homogeneous, white, translucent substrate, the silver salt being present in in a molar ratio of 1.5/1 to 6.2/1 with respect to said acid.

2. The system of claim 1 wherein said acid has from 10 to 30 carbon atoms.

3. The system of claim 1, wherein the acid of the silver salt has from 10 to 30 carbon atoms.

4. The system of claim 1 wherein the acid and the acid of the silver salt have from 10 to 30 carbon atoms.

5. The system of claim 1 wherein said substrate comprises a polyester film loaded with oxide particles and the opacity of the substrate is between 80 and 99%.

6. The system of claim 4 wherein said substrate comprises a polyester film loaded with oxide particles and the opacity of the substrate is between 90 and 99%.

7. The system of claim 1 wherein said translucent substrate contains particulate matter and/or vesicles to provide the translucency.

* * * * *